US011624538B2

(12) United States Patent
Parrabbi

(10) Patent No.: US 11,624,538 B2
(45) Date of Patent: Apr. 11, 2023

(54) REFRIGERATION DEVICE PROVIDED WITH A SECONDARY BY-PASS BRANCH AND METHOD OF USE THEREOF

(71) Applicant: ANGELANTONI TEST TECHNOLOGIES S.R.L.—IN BREVE ATT S.R.L., Massa Martana PG (IT)

(72) Inventor: Patrizio Parrabbi, Massa Martana PG (IT)

(73) Assignee: ANGELANTONI TEST TECHNOLOGIES SRL-IN BREVE ATT SRL, Massa Martana PG (IT)

( * ) Notice: Subject to any disclaimer, the term of this patent is extended or adjusted under 35 U.S.C. 154(b) by 0 days.

(21) Appl. No.: 17/258,569

(22) PCT Filed: Jul. 9, 2019

(86) PCT No.: PCT/IB2019/055826
§ 371 (c)(1),
(2) Date: Jan. 7, 2021

(87) PCT Pub. No.: WO2020/012348
PCT Pub. Date: Jan. 16, 2020

(65) Prior Publication Data

US 2021/0270504 A1 Sep. 2, 2021

(30) Foreign Application Priority Data

Jul. 11, 2018 (IT) ..... 102018000007108

(51) Int. Cl.
*F25B 41/40* (2021.01)
*F25B 49/02* (2006.01)
(Continued)

(52) U.S. Cl.
CPC ..... *F25B 49/02* (2013.01); *F25B 41/20* (2021.01); *F25B 41/24* (2021.01);
(Continued)

(58) Field of Classification Search
CPC ..... F25B 41/20; F25B 41/24; F25B 49/02; F25B 2400/0403; F25B 2400/0409;
(Continued)

(56) References Cited

U.S. PATENT DOCUMENTS 4,877,046 A * 10/1989 Albrigtsen ..... F25B 41/24 137/107
2009/0248212 A1 10/2009 Cowans et al.
(Continued)

FOREIGN PATENT DOCUMENTS

CN 103874896 6/2014
EP 3 067 645 9/2016
(Continued)

OTHER PUBLICATIONS

International search report and written opinion issued by the EPO dated Sep. 11, 2019 for PCT/IB2019/055826.
(Continued)

*Primary Examiner* — Jonathan Bradford
(74) *Attorney, Agent, or Firm* — Silvia Salvadori

(57) ABSTRACT

A refrigeration device (100) having a closed circuit (C) within which a refrigerant fluid circulates and provided with a compressor and at least one shut-off valve (105) operable between an open position and a closed position to regulate the flow of refrigerant fluid through at least one evaporator depending on the temperature required by the user, the closed circuit includes at least one secondary by-pass branch (200) having an inlet section (201) and an outlet section
(Continued)

(202) respectively arranged downstream (D) and upstream (U) of said at least one compressor (101) for the passage of said refrigerant fluid.

15 Claims, 3 Drawing Sheets

(51) Int. Cl.
*F25B 41/24* (2021.01)
*F25B 41/20* (2021.01)

(52) U.S. Cl.
CPC ..... *F25B 2600/0261* (2013.01); *F25B 2600/2501* (2013.01); *F25B 2600/2519* (2013.01); *F25B 2700/1933* (2013.01)

(58) Field of Classification Search
CPC ..... F25B 2600/0261; F25B 2600/2501; F25B 2600/2519; F25B 2700/1933
See application file for complete search history.

(56) References Cited

U.S. PATENT DOCUMENTS

2015/0285539 A1* 10/2015 Kopko ..... F25B 49/02 62/324.1
2016/0047595 A1* 2/2016 Williams ..... F25D 17/06 62/62

FOREIGN PATENT DOCUMENTS

EP 3 315 880 5/2018
JP 2007232232 A * 9/2007 ..... F25B 29/003
WO 20130050055 4/2013

OTHER PUBLICATIONS

Office Action issued dated Jan. 26, 2022 by the CN Patent Office for corresponding CN patent application No. 201980045203.3.
Reporting Letter from the CN Local agent for corresponding CN patent application No. 201980045203.3.

* cited by examiner

REFRIGERATION DEVICE PROVIDED WITH A SECONDARY BY-PASS BRANCH AND METHOD OF USE THEREOF

This application is a U.S. national stage of PCT/IB2019/055826 filed on 9 Jul. 2019, which claims priority to and the benefit of Italian Application No. 102018000007108 filed on 11 Jul. 2018 the contents of which are incorporated herein by reference in their entireties.

FIELD OF THE INVENTION

The present invention concerns a refrigeration device and related operating method. In particular, such invention concerns a refrigeration device applied in the climatic chambers used to test the resistance of mechanical or electrical components and products of various types and functions against temperature/humidity changes.

KNOWN PRIOR ART

According to known art, a refrigeration device for a climatic chamber, or in general for a user which, for example, an intermediate heat transfer fluid whose temperature must be regulated, or one or more cascade refrigerating units, comprises a closed circuit within which a refrigerant fluid circulates. Such closed circuit comprises a compressor for the circulation of the fluid within the closed circuit, a condenser, an expansion valve of the thermostatic type, an evaporator, and a shut-off valve to allow/prevent the passage of the fluid towards the evaporator, in order to regulate the flow of refrigerant fluid through the evaporator depending on the temperature required by the user. With regard to this, the closed circuit further comprises a secondary by-pass branch, or also named "hot gas branch," having an inlet section and an outlet section respectively arranged downstream and upstream of the compressor for the passage of the hot refrigerant fluid when the first shut-off valve prevents the passage of the refrigerant fluid towards the evaporator. Still according to known art, the secondary by-pass branch can comprise, in parallel, a line for injecting refrigerant liquid by means of a dedicated thermostatic valve to cool the fluid passing through it and a passage valve operable between an open position, to allow the fluid to recirculate between the secondary by-pass branch and the compressor, at least when the shut-off valve prevents the passage of fluid towards the evaporator, and a closed position to prevent the passage of the refrigerant fluid through the secondary by-pass branch.

In a climatic chamber, during the temperature regulation steps, in particular when the maximum refrigeration load is not required but rather has to be modulated, instead of turning the compressor off and back on, as occurs for example in domestic refrigerators, the aforesaid by-pass line is open to safeguard the life of the compressor and to ensure a good regulation. In practice, the compressor stays turned on and recirculates the gas on itself along the by-pass line, whereas the cold line, i.e. the one passing through the evaporator, stays closed intermittently or cyclically.

Moreover, in such devices of the known art, the by-pass line has a very reduced section with respect to the main line, such as to maintain, between the delivery and suction of the compressor, the pressure difference there is when the evaporator is active so that the compressor maintains a homogeneous operating condition.

However, if the above solution allows not to turn off the compressor and to, consequently, preserve its integrity over time on one hand, it nonetheless leads to a constant mechanical work of the compressor during the opening of the by-pass line on the other, thus maintaining high energy consumption also in the steps in which refrigeration load is not required by the user. Such solution is thus not very convenient both economically and in terms of energy. Moreover, also if the characteristics of operation of the compressor need to be modified, such as, for example, the work capacity or load to which it is subjected, only when the refrigerant fluid circulates within the by-pass line and the passage valve is thus open, there would be consequences along the entire circuit, especially at the evaporator. Practically, it would be extremely complicated, if not impossible, to be able to finely regulate the temperature at the evaporator.

Thus, an object of the present invention is to implement a refrigeration device for which, when the evaporator is not active, a reduced operation of the work of the compressor can be achieved without influencing the operation of the evaporator, i.e. to be able to continue to finely regulate the temperature of the user.

Moreover, an object of the present invention is to implement a refrigeration device that solves the problems of the known art in a simple manner and with minimum changes with respect to the refrigeration devices of the known art.

Finally, an object of the present invention is to implement a method that, when the evaporator is not active, allows to reduce the consumption of the compressor without consequences along the entire circuit of the refrigeration device, in particular at the evaporator.

SUMMARY OF THE INVENTION

These and further objects are reached by a refrigeration device having a closed circuit within which a refrigerant fluid circulates, said closed circuit comprising at least one compressor, at least one condenser, expansion means of said refrigerant fluid, at least one evaporator to thermally condition, directly or indirectly, at least one user, and at least one shut-off valve operable between an open position and a closed position to regulate the flow of refrigerant fluid through said at least one evaporator depending on the temperature required by said at least one user, said closed circuit further comprising at least one secondary by-pass branch having an inlet section and an outlet section respectively arranged downstream and upstream of said at least one compressor for the passage of said refrigerant fluid, said secondary by-pass branch comprising at least one passage valve operable between an open position, to allow the fluid to recirculate between said secondary by-pass branch and said at least one compressor, and a closed position, to prevent the passage of fluid through said secondary by-pass branch, characterized in that said closed circuit comprises means to prevent the backflow of said refrigerant fluid from said condenser to said compressor, at least when said passage valve is open, said means to prevent the backflow of said refrigerant fluid being arranged between said condenser and said inlet section of said secondary by-pass branch.

The objects described above are reached thanks to the presence of means to prevent the backflow of said refrigerant fluid from the condenser to the compressor since they prevent the fluid already inside the condenser from backflowing to the compressor and modifying the operating conditions of the compressor, whenever the load conditions of the compressor need to be modified, such as for example, reducing its load and thus consumptions, while making it possible to continue to finely regulate the temperature of the user. The backflow of fluid from the condenser to the condenser could also occur at the closing of the passage valve and/or at the re-opening of the shut-off valve, when the pressure at the condenser could be above that at the delivery of the compressor. In such situation, thanks to the presence of the means to prevent the backflow of said refrigerant fluid from the condenser to the compressor, it is impossible for the fluid inside the condenser to go back in the compressor itself. The refrigerant fluid is thus allowed to reach a new pressure balance to be able to operate correctly without however registering any reversed flow of the refrigerant fluid from the condenser to the compressor.

It should be noted that user either means climatic chamber, or one or more refrigerating units in cascade, or an intermediate heat transfer fluid whose temperature has to be regulated.

Moreover, said means to prevent the backflow of said refrigerant fluid are arranged near to or at said inlet section of said secondary by-pass branch.

Moreover, in fact, the more such means to prevent the backflow of said refrigerant fluid are arranged near to, or even at the inlet section of the secondary by-pass branch, the greater the advantages will be in terms of the efficiency achieved since the mass of refrigerant fluid recirculating within the compressor and along the secondary by-pass branch will decrease once the passage valve is open. Further advantages are achieved whenever the inlet and outlet sections of the secondary by-pass branch are respectively at the delivery section and at the suction section of the compressor.

Advantageously, said at least one secondary by-pass branch is sized and shaped so that the regime pressure difference between upstream and downstream of said at least one compressor, when said at least one passage valve is in its open position and said at least one shut-off valve is in its closed position, is lower than the regime pressure difference between upstream and downstream of said at least one compressor, when said at least one shut-off valve allows the passage through said at least one evaporator and said passage valve is in its closed position. This offers advantages compared to the refrigeration devices of the known art which, as mentioned above, have a secondary by-pass branch having a very reduced section with respect to the main line of the closed circuit, with two negative effects: first, there is a high circuit noise due to the expansion of gas inside the suction line of the compressor; secondly, the electric consumption of the motor is anyhow high given that it works on the load there would be with the evaporator active. Instead, the solution suggested allows, when the evaporator is not active, to considerably reduce the noise of the refrigeration device and to make the compressor of the refrigeration system operate at a lower load with respect to the regime one in a simple way. This leads to reduce energy costs of the compressor and thus the total energy costs of the climatic chamber in which such refrigeration device is installed. Such advantageous conclusion is even made clearer in that, normally, the by-pass line of an refrigeration device operating, for example, in a climatic chamber works about 60% to 75% of the total operating time of the climatic chamber itself. Thus, a consumption reduction of the compressor has significant effects on the general consumptions of the system. Thus, the presence of means to prevent the backflow of the refrigerant fluid from the condenser to the compressor in such situation is even more effective since the resistance to the refrigerant fluid feed along the secondary by-pass branch is lower with respect to the one achieved in the devices of the known art, thus in the transients when the passage valve is opening, the refrigerant fluid would be more likely to have a higher pressure at the condenser than that at the compressor.

Preferably, the secondary by-pass branch section is identical to the suction and delivery sections of the compressor.

Still according to the invention, said at least one secondary by-pass branch is sized and shaped so that the regime pressure difference between upstream and downstream of said compressor, at least when said at least one passage valve is in its open position and said shut-off valve is in its closed position, is lower than 4 bars, preferably lower than 1 bar. In practice, there are greater energy savings effects when the compressor basically operates at vacuum. This allows to achieve the maximum energy savings for the compressor. The pressure difference reached between upstream and downstream, lower than 4 bars, preferably lower than 1 bar, is the minimum one that can technically be reached by the compressor, given both the size of the ducts for the connection between upstream and downstream of the compressor and the presence of the passage valve and the shape of the ducts, studied so that to allow a complete backflow of the working fluid from downstream to upstream of the compressor with the minimum pressure losses possible.

Moreover, said at least one passage valve is such as to minimize the pressure losses, i.e. it allows the complete and uninterrupted passage of the working fluid through the valve itself In practice, said at least one passage valve is sized so that the passage section of the refrigerant fluid, when said valve is open, is substantially equal to the section of said secondary by-pass branch section in order to basically reduce the pressure losses to zero during the passage of the refrigerant fluid inside the passage valve.

In particular, said means to prevent the backflow of said refrigerant fluid comprise at least one non-return valve that, in this case, is preferably arranged near to the inlet section of said secondary by-pass branch.

Moreover, in alternative to such non-return valve, said means to prevent the backflow of said refrigerant fluid comprise at least one second shut-off valve respectively operable between an open position and a closed position to allow or prevent the passage of said refrigerant fluid. Advantageously, said at least one second shut-off valve is in an open position, at least when said passage valve is closed, and in its closed position, at least when said passage valve is open.

In this case, such second shut-off valve is preferably arranged near to the inlet section of said secondary by-pass branch.

According to a further alternative embodiment of the invention, said passage valve and said means to prevent the backflow of said refrigerant fluid comprise a three-way valve provided with at least one inlet section, at least one first outlet section and at least one second outlet section, which are closable/openable on command. Such three-way valve is arranged so that said inlet section is fluidically connected to the outlet of said compressor, said first outlet section is fluidically connected to said secondary by-pass branch and said second outlet section is fluidically connected to said condenser, and functionally operating so that when said first outlet section is open, said at least second outlet section is closed, and vice-versa.

In this case, such three-way valve is preferably arranged exactly at the inlet section of said secondary by-pass branch.

Moreover, the refrigeration device further comprises at least one pressure sensor to take the pressure of the fluid entering said at least one compressor and at least one control unit adapted to control the opening of said at least one passage valve, at least when said pressure sensor detects that the pressure of the fluid entering the compressor is identical to a first predetermined value, whereas it controls the closing of said at least one passage valve when a second predetermined pressure is achieved, higher than the first predetermined pressure.

The patentee has indeed experimented that the maximum energy savings are achieved not only by limiting the pressure to the maximum between upstream and downstream of the compressor, along the by-pass line, but also when the passage valve is open at a first predetermined pressure and is closed at a second predetermined pressure. Preferably, said first predetermined pressure is lower of a value between 0.1 and 2 bars than the absolute pressure, calculated during the design phase, of the refrigerant fluid inside said evaporator, capable of maintaining said user at the desired temperature according to a refrigerant fluid used and to the size of said user, and said second predetermined pressure is higher of a value between 0.1 and 1.9 bars than said first predetermined pressure and is not higher than said absolute pressure, calculated during the design phase, of the refrigerant gas inside said evaporator, capable of maintaining said user at the desired temperature according to the refrigerant gas used and to the size of said user.

It should be noted that, for each temperature desired for the user, a theoretical absolute pressure value of the refrigerant fluid to expect inside the evaporator is defined, according to the type of refrigerant fluid used and also to the size of the user itself, to maintain the desired temperature for the user. Thus, such design pressure value can be obtained for each temperature desired, once the size of the user to be served and the refrigerant fluid to be used are defined. In practice, once the user and the refrigerant fluid have been established, it is possible to define a table of the design pressures of the evaporator for each temperature desired by the user. Such design pressure is then useful in establishing the first pressure and the second pressure, respectively, of the opening and closing of the passage valve along the by-pass line.

Moreover, according to a further embodiment of the invention, said secondary by-pass branch can comprise at least one heat exchanger to cool the fluid passing through said secondary by-pass branch; such heat exchanger is outside of said at least one secondary by-pass branch. It should be noted that outside heat exchanger means a heat exchanger that works with a refrigerant fluid distinct from the operating refrigerant fluid circulating within the closed circuit of the refrigeration device. Preferably, said at least one outside heat exchanger is of the plate type, or of the air type or the tube type. The combined action of the pressure drop reduction between upstream and downstream of the compressor, with the shut-off valve closed and the passage valve open, and the presence on the line of the volume contained inside the exchanger further limits the noise of the by-pass line when the evaporator is not active.

Still according to the invention, the objects are achieved thanks to a method for operating at least one refrigeration device, at least when said at least one compressor is operative and in full operation, i.e. is not in its start-up or stop conditions, comprising the steps of:

a) regulating the flow of said refrigerant fluid through said at least one evaporator depending on the temperature required by said user by means of said at least one shut-off valve;

b) recirculating said refrigerant fluid between said secondary by-pass branch and said at least one compressor;

characterized in that said step b) comprises the step b1) of opening said at least one passage valve, and the step b2) of preventing the backflow of the refrigerant fluid from said condenser to said compressor.

Preferably, said at least one secondary by-pass branch is sized and shaped so that the regime pressure difference between upstream and downstream of said at least one compressor, when said at least one passage valve is in its open position, is lower than the regime pressure difference between upstream and downstream of said at least one compressor, when said at least one shut-off valve allows the passage through said at least one evaporator and said passage valve is in its closed position. Preferably, said at least one secondary by-pass branch is sized and shaped so that the regime pressure difference between upstream and downstream of said compressor, at least when said at least one passage valve is in its open position and said shut-off valve is in its closed position, is lower than 4 bars and, preferably, lower than 1 bar. In practice, there are greater energy savings effects when the compressor basically operates at vacuum.

Moreover, still according to the method object of the invention, before said step b1), the step b0) is comprised of detecting the pressure of the inlet fluid entering said compressor by means of said pressure sensor, and in that said step b1) comprises the further step b3) of opening said at least one passage valve at least when the pressure detected by said pressure sensor at the inlet of said compressor during said step b0) reaches a first predetermined pressure. Preferably, said first predetermined pressure is lower of a value between 0.1 and 2 bars than the absolute pressure calculated during the design phase, or design pressure, of the refrigerant fluid inside said evaporator, capable of maintaining said user at the desired temperature according to the refrigerant gas used and to the size of said user.

Moreover, after said step b3) the step b4) is comprised of closing said at least one passage valve at least when the pressure detected by said pressure sensor at the inlet of said compressor during said step b0) reaches a second predetermined pressure higher than the first predetermined pressure. Preferably, said second predetermined pressure is higher of a value between 0.1 and 1.9 bars than said first predetermined pressure and is not higher than said absolute pressure (Pprog) calculated during the design phase, or design pressure, of the refrigerant gas inside said evaporator, capable of maintaining said user at the desired temperature according to the refrigerant gas used and to the size of said user.

According to the invention, said method following said step b) further comprises the step c) of cooling, by means of said at least one heat exchanger, the refrigerant fluid circulating inside said secondary by-pass branch during said step b) of the method.

BRIEF DESCRIPTION OF THE FIGURES

These and other aspects of the present invention will become clearer by the following detailed description of a preferred embodiment provided herein by way of example only and without limitations, with reference to the accompanying figures, in which.

DETAILED DESCRIPTION OF A PREFERRED EMBODIMENT OF THE PRESENT INVENTION

With reference to the figures above, a refrigeration device 100 according to the invention is shown.

Figure 1:
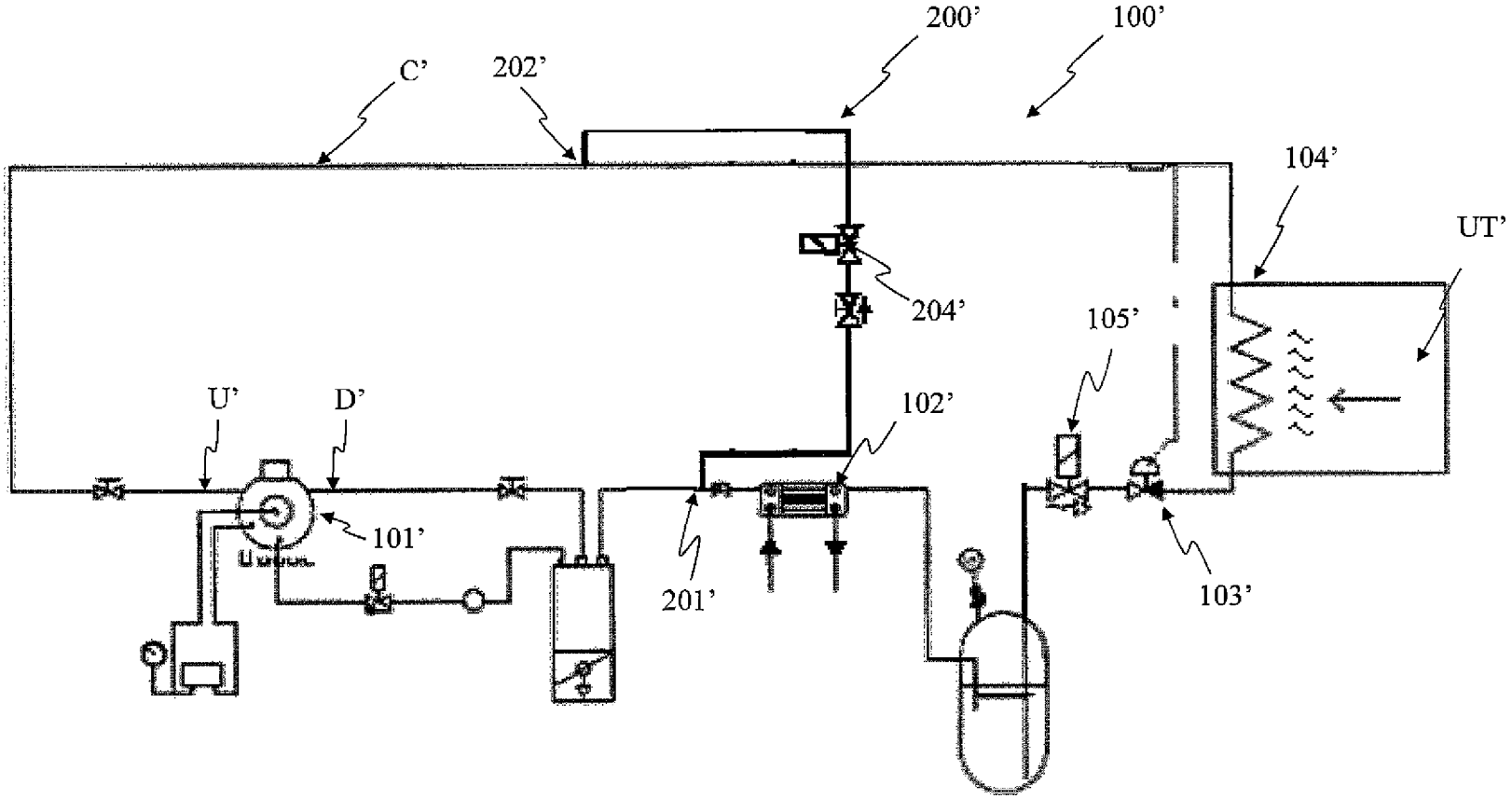
Fig. 1 PRIOR ART
FIG. 1 shows a view of the scheme of operation of a refrigeration system of the known art.

Instead, FIG. 1 shows a refrigeration device 100' of the known art for climatic chamber. Such refrigeration device 100' of the known art has a closed circuit C' inside which a refrigerant fluid circulates. Such closed circuit C' comprises a compressor 101', a condenser 102', a thermostatic expansion valve 103', an evaporator 104', and a shut-off valve 105' to allow/prevent the passage of fluid in direction of the evaporator 104'. The closed circuit C' further comprises a secondary by-pass branch 200' having an inlet section 201' and an outlet section 202' respectively arranged downstream D' and upstream U' of the compressor 101' for the passage of the hot refrigerant fluid when the shut-off valve 105' prevents the passage of fluid in direction of the evaporator 104'. Such secondary by-pass branch 200' also comprises a passage valve 204' operable between an open position, to allow the fluid to recirculate between the secondary by-pass branch 200' and the compressor 101', and a closed position to prevent the passage of fluid through the secondary by-pass branch 200'. Always as shown in FIG. 1, the secondary by-pass branch 200' is sized and shaped so that the regime pressure difference $\Delta P_{bypass}$ between upstream U' and downstream D' of the compressor 101', when the passage valve 204' is in its open position and said shut-off valve is in its closed position, is identical to the regime pressure difference ΔP between upstream U' and downstream D' of the compressor 101', when the shut-off valve 105' allows the passage through the evaporator 104' and the passage valve 204' is in its closed position. Thus, in practice, along the secondary by-pass branch 200' and between upstream and downstream of the compressor 101', a pressure drop $\Delta P_{bypass}$, identical to the one achieved along the main line of the closed circuit C', between downstream D' and upstream U' of the compressor 101' itself, is achieved.

Figure 2:
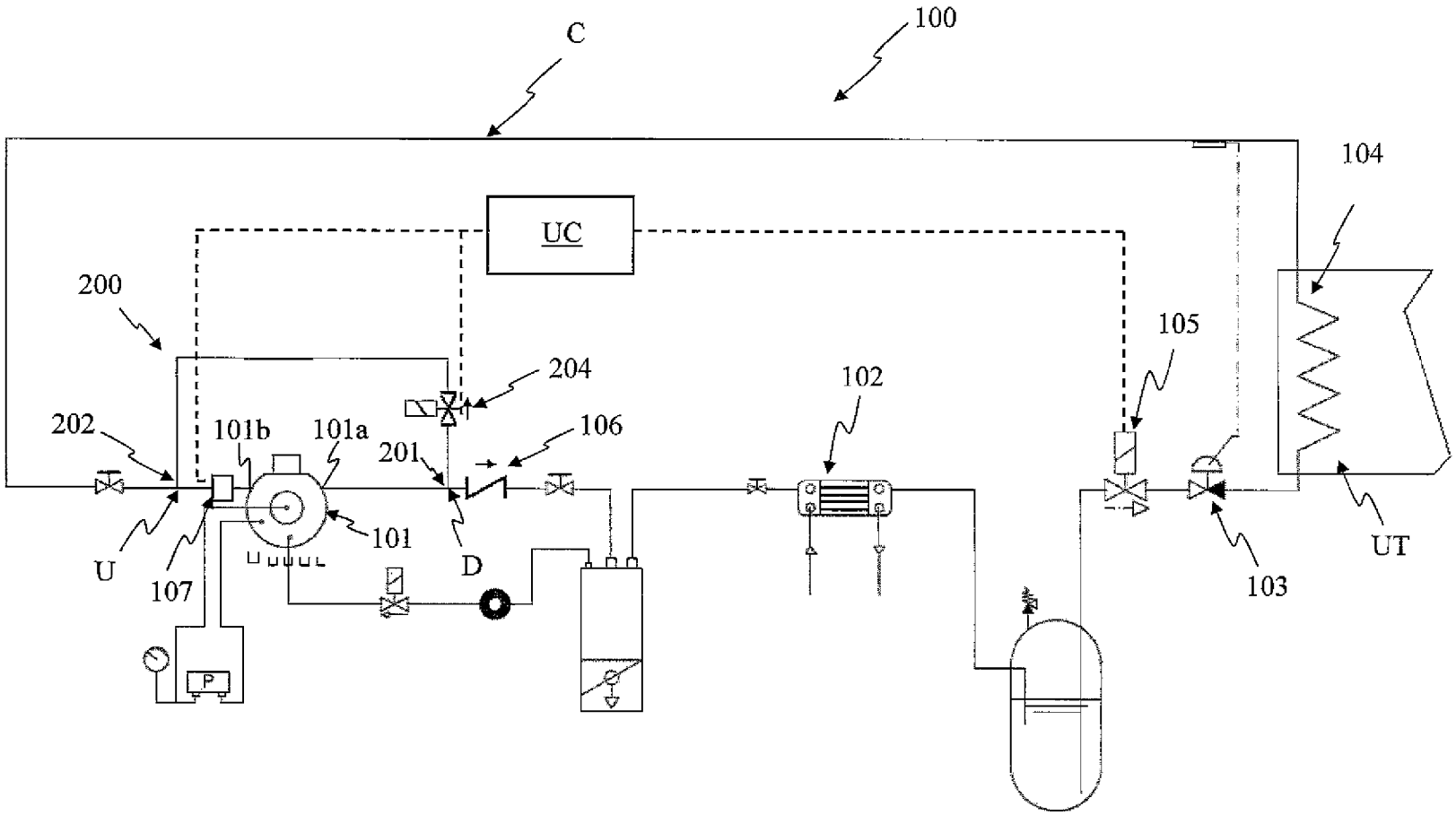
FIG. 2 shows a view of the scheme of operation of a refrigeration system according to the invention.

This way, the compressor 101' is always operated in the same way, without load variations or operating interruptions, also when the evaporator 104' is not used. Instead, FIG. 2 shows a refrigeration device 100 for climatic chamber according to the invention.

Such refrigeration device 100 has a closed circuit C inside which a refrigerant fluid circulates. Such closed circuit C comprises a compressor 101, a condenser 102, expansion means 103 of the refrigerant fluid such as, for example, a thermostatic expansion valve 103, an evaporator 104 to thermally condition, indirectly, a user UT such as, for example, an environmentally controlled chamber, and a shut-off valve 105 operable between an open position and a closed position to regulate the flow of refrigerant fluid through the evaporator 104 depending on the temperature required by the user UT.

It should be underlined that such expansion means 103 can alternatively also comprise a capillary without thereby departing from the scope of protection of the present invention.

Moreover, it should also be clarified that, although known to the field technician, the shut-off valve 105 operates cyclically, i.e. has a fixed operating period (for example 10 seconds in this case) during which an opening step and a closing step can be controlled. The duration of the opening and closing steps can vary at each interval period depending on the requirements of the user UT. For example, if the user UT requires a temperature of +20° C., starting form a temperature of −20° C., then the shut-off valve 105 will have a considerably longer closing step interval than the opening one, at the limit, the shut-off valve 105 will remain closed for a prolonged period until the desired temperature is reached inside the user UT. Clearly, in the opposite case, the shut-off valve 105 will remain open for a rather prolonged period. If a given temperature should be maintained constant inside the user, then the interval of the opening and closing steps will be appropriately determined, period by period, in order to maintain the desired temperature inside the user UT.

The closed circuit C further comprises a secondary by-pass branch 200 having an inlet section 201 and an outlet section 202 respectively arranged downstream D and upstream U of the compressor 101 for the passage of the refrigerant fluid.

In the embodiment described herein, the secondary by-pass branch 200 comprises a passage valve 204 operable between an open position, to allow the fluid to recirculate between the secondary by-pass branch 200 and the compressor 101, and a closed position to prevent the passage of fluid through the secondary by-pass branch 200.

According to the invention, the closed circuit C further comprises means 106 to prevent the backflow of the refrigerant fluid from the condenser 102 to the compressor 101, at least when the passage valve 204 is open. Such means 106 to prevent the backflow of the refrigerant fluid are arranged between the condenser 102 and the inlet section 201 of the secondary by-pass branch 200.

In particular, said means to prevent the backflow of said refrigerant fluid 106 are arranged near the inlet section 201 of the secondary by-pass branch 200.

Further advantages, although not shown in the accompanying figures, are achieved whenever the inlet 201 and outlet 202 sections of the secondary by-pass branch 200 are respectively at the delivery section 101*a* and at the suction section 101*b* of the compressor 101.

According to the invention, the secondary by-pass branch 200 is sized and shaped so that the regime pressure difference $\Delta P_{bypass}$ between upstream U and downstream D of the compressor 101, when the passage valve 204 is in its open position and the shut-off valve 105 is in its closed position, is lower than the regime pressure difference ΔP between upstream U and downstream D of the compressor 101, when the shut-off valve 105 allows the passage through the evaporator 104 and the passage valve 204 is in its closed position. It should be noted that, according to the particular embodiment described herein, the regime pressure difference ΔP between upstream U and downstream V of the compressor 101, when the passage valve 204 is in its closed position and the shut-off valve 105 allows the passage of fluid through the evaporator 104, is of about 18 bars. Therefore, any pressure difference $\Delta P_{bypass}$ between upstream U and downstream D of the compressor 101, when the passage valve 204 is in its open position and the shut-off valve 105 is in its closed position, that is lower than the one achieved with the shut-off valve 105 open and the passage valve closed 204 and thus lower than 18 bars, allows to considerably reduce the energy consumed by the compressor 101 and, consequently, the energy costs required by the refrigeration device 100.

According to the embodiment described herein, the secondary by-pass branch 200 is sized and shaped so that the regime pressure difference $\Delta P_{bypass}$ between upstream U and downstream D of the compressor 101, when the passage valve 204 is in its open position and the shut-off valve 105 is in its closed position, is lower than 1 bar. In other embodiments, such pressure can also be lower than 4 bars without thereby departing from the scope of protection of the present invention. Any way, theoretically, when technically possible, the lower the regime pressure difference $\Delta P_{bypass}$ between upstream U and downstream D of the compressor 101, when the passage valve 204 is in its open position and the shut-off valve 105 does not allow the passage of fluid through the evaporator 104, the greater the benefits achievable both in terms of energy and in the decrease of the noise of the refrigeration device 100.

Moreover, the patentee has noted that when the by-pass 200 is active, thus when the passage valve 204 is in its open position, there is no need to cool the gas that continuously goes inside the compressor 101 since the temperature taken is always lower than +80° C.

Moreover, the passage valve 204 is sized so that the passage section of the refrigerant fluid, when the passage valve 204 is open, is substantially equal to the section of the secondary by-pass branch 200 in order to basically reduce the pressure losses to zero. In practice, the passage valve 204 is sized so that to allow the complete passage of fluid without any choking of the fluid passing through the valve 204 itself, thus minimizing the concentrated pressure losses.

In the embodiment described herein, the preventing means 106 comprise a non-return valve 106 functionally arranged between the inlet section 201 of the secondary by-pass branch 200 and the condenser 102 to prevent the backflow of fluid towards the compressor 101.

Such non-return valve is arranged near the inlet section 201. In fact, the closer the non-return valve 106 is arranged to the inlet section 201, the better will be the behavior of the compressor 101 since the fluid mass to recirculate along the by-pass branch 200 will be lower.

Such non-return valve 106 can, in alternative, be replaced by a second shut-off valve (not shown here) capable of opening and closing and thus allowing or preventing the passage of the refrigerant fluid from the condenser 102 to the compressor 101. In particular, such second shut-off valve is in open position, at least when the passage valve 204 is closed, and in its closed position, at least when the passage valve 204 is open.

In a further alternative embodiment of the invention not shown here, the passage valve 204 along the secondary by-pass branch 200 and the means 106 to prevent the backflow of the refrigerant fluid comprise a three-way valve. Such three-way valve, not shown here, is provided with an inlet section, a first outlet section and a second outlet section, which are closable/openable on command. Such three-way valve is arranged so that the inlet section is fluidically connected to the outlet of the compressor 101, the first outlet section is fluidically connected to the secondary by-pass branch 200 and the second outlet section is fluidically connected to the condenser 102, and functionally operating so that when the first outlet section is open, the second outlet section is then closed, and vice-versa. In this embodiment, such three-way valve is preferably arranged exactly at the inlet section 201 of the secondary by-pass branch 200.

According to the invention, the refrigeration device 100 further comprises a pressure sensor 107 arranged at the suction of the compressor 101, to take the pressure of the fluid entering the compressor 101 and a control unit UC adapted to control the opening of the passage valve 204 at least when the shut-off valve 105 is closed and when the pressure sensor 107 detects that the pressure of the fluid entering the compressor 101 is identical to a first predetermined value P1, whereas it controls the closing of the passage valve 204 when a second predetermined pressure P2, higher than the first predetermined pressure P2>P1, is achieved.

The patentee has in fact experimented that the maximum energy savings are achieved not only by limiting the pressure difference between upstream U and downstream D of the compressor 101 at the most, but also when the passage valve 204 is open at a first predetermined pressure P1 and is closed at a second predetermined pressure P2, wherein the first predetermined pressure P1 is lower of a value between 0.1 and 2 bars than the absolute pressure Pprog, calculated during the design phase, of the refrigerant fluid inside the evaporator 104, capable of maintaining the user at the desired temperature according to the refrigerant fluid used and to the size of the user itself, and the second predetermined pressure P2 is higher of a value between 0.1 and 1.9 than the first predetermined pressure P1 and not higher than the aforesaid absolute pressure Pprog, calculated during the design phase, of the refrigerant gas inside the evaporator 104, capable of maintaining the user at the desired temperature according to the refrigerant gas used and to the size of said user.

It should be noted that, for each temperature desired for the user, a theoretical absolute pressure value of the refrigerant fluid to expect inside the evaporator is defined, according to the type of refrigerant fluid used and also to the size of the user itself. Thus, such design pressure value can be obtained for each temperature desired, once the type and size of the user to be served and the refrigerant fluid to be used are also defined.

According to the embodiment described herein, the first predetermined pressure is 0.9 bar, whereas the second predetermined pressure is 1.5 bars. The design pressure, as defined above, at the desired temperature of −20° C. within the chamber to be thermally regulated is of 1.7 bars (absolute). As mentioned above, in the event different temperatures must be reached at the evaporator 104, the design pressure Pprog, or pressure calculated during the design phase, as defined above, would clearly be different, and both the first predetermined pressure and the second predetermined pressure would probably be different.

Figure 3:
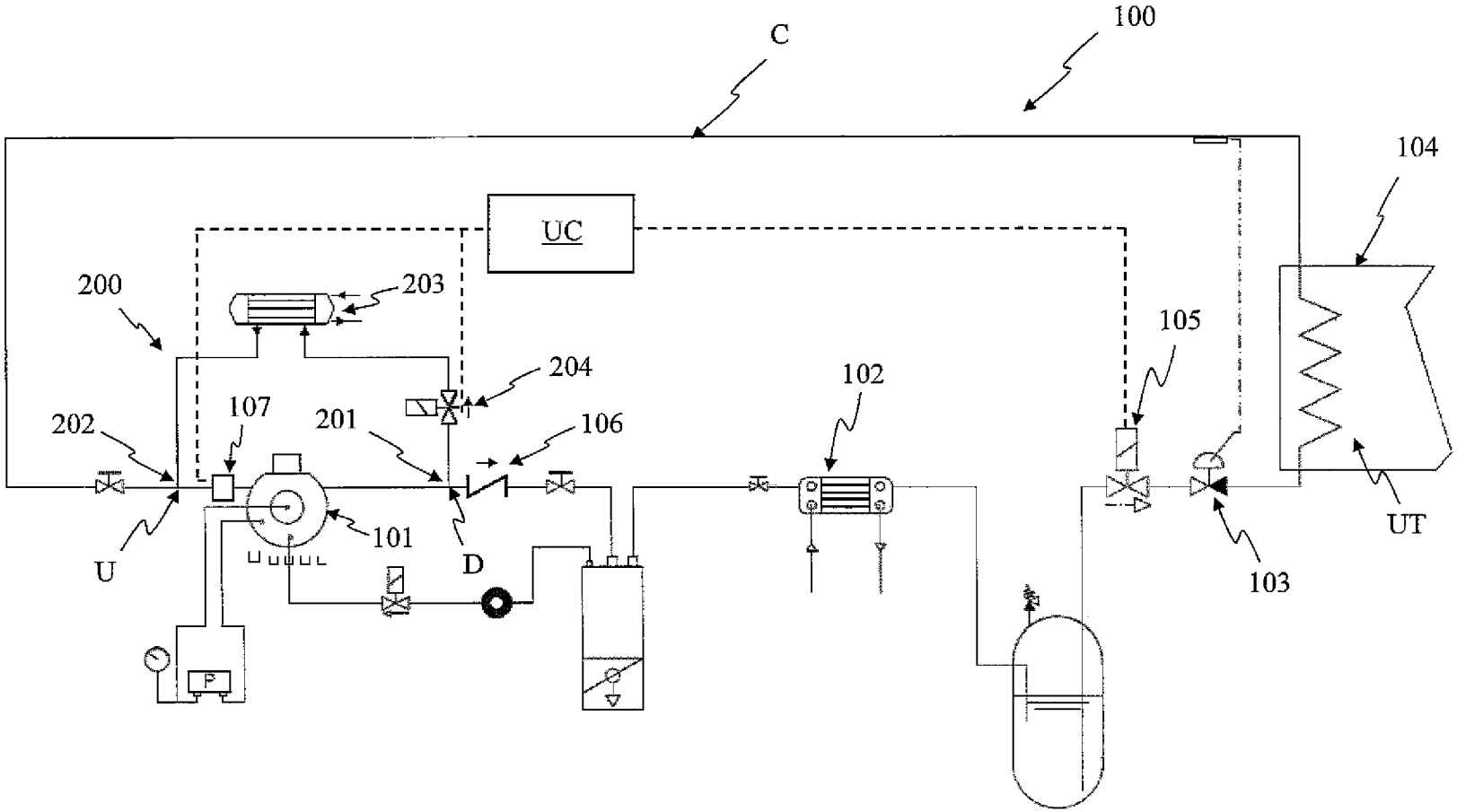
FIG. 3 shows a view of the scheme of operation of a refrigeration system according to a second embodiment of the invention.

FIG. 3 shows an embodiment similar to the one described in FIG. 2, but wherein the secondary by-pass branch 200 comprises a heat exchanger 203 to cool the refrigerant fluid passing through it. According to the embodiment described herein, the heat exchanger 203 is outside of the secondary by-pass branch 200 and is, in the embodiment described herein, of the plate type. This way, the noise of the refrigeration device 100 is still more reduced when the evaporator 104 is not operating.

According to the first embodiment of the invention shown in FIG. 2, the operating method of the refrigeration device 100 with the compressor 101 operative and in full operation, i.e. not in its start-up or stop conditions, comprises the steps of:

a) regulating the flow of the refrigerant fluid through the evaporator 104 depending on the temperature required by the user UT by means of the shut-off valve 105; and b) recirculating the refrigerant fluid between the secondary by-pass branch 200 and the compressor 101.

Advantageously, the step b) comprises the step b1) of opening the passage valve 204, and the step b2) of preventing the backflow of the refrigerant fluid from the condenser 102 to the compressor 101. In particular, the secondary by-pass branch 200 is sized and shaped so that the regime pressure difference $\Delta P_{bypass}$ between upstream U and downstream D of the compressor 101, when the passage valve 204 is in its open position and the shut-off valve 105 is in its closed position, is lower than the regime pressure difference $\Delta P$ between upstream U and downstream D of the compressor 101, when the shut-off valve 105 allows the passage through the evaporator 104 and the passage valve 204 is its closed position. In particular, such pressure $\Delta P_{bypass}$ is lower than 4 bars and is preferably lower than 1 bar.

Advantageously, according to the method, before the step b1), the step b0) is comprised of detecting the pressure P of the fluid entering the compressor 101 by means of the pressure sensor 107 arranged at the suction of the compressor 101, and the step b) comprises the further step b3) of opening the passage valve 204 at least when the pressure detected by the pressure sensor 107 at the inlet of the compressor 101 during the step b0) reaches a first predetermined pressure P1, wherein such first predetermined pressure is lower of a value between 0.1 and 2 bars than the absolute pressure (Pprog), calculated during the design phase, of the refrigerant gas inside the evaporator 104, capable of maintaining the user at the desired temperature according to the refrigerant gas used and to the size of the user itself.

Still according to the method, after the step b3), the step b) comprises the step b4) of closing the passage valve 204 at least when the pressure detected by said pressure sensor 107 at the inlet of said compressor 101 during said step b0) reaches a second predetermined value higher than the first predetermined pressure. Such second predetermined pressure is higher of a value between 0.1 and 1.9 bars than the first predetermined pressure P1 and is anyway not higher than the absolute pressure Pprog, calculated during the design phase, of the refrigerant gas inside the evaporator 104, capable of maintaining the user at the desired temperature according to the refrigerant gas used and to the size of the user itself.

It should be noted that the closing of the passage valve 204 is totally independent of the shut-off valve 105. In fact, the latter could be completely open from the time of the closing of the passage valve 204. Any way, the energy savings at the compressor 101 are achieved the longer the shut-off valve 105 remains closed and the passage valve 204 remains open to recirculate the refrigerant fluid inside the secondary by-pass branch 200.

A numerical operation example of the refrigeration device according to the invention is shown here below.

If the user UT is a climatic chamber and the refrigerant fluid is a gas R449A, it is calculated during the design phase that in order to maintain the temperature at −35° C. within the climatic chamber, the design pressure Pprog of the refrigerant fluid at the evaporator 104 is of 1.2 bars just to maintain such chamber at the temperature of −35° C., corresponding to a temperature of evaporation of −40° C., whereas for the same chamber that operates with the same refrigerant gas, at a temperature of +20° C., the design pressure Pprog of the refrigerant fluid at the evaporator is 1.8 bars to maintain such chamber just at the temperature of +20° C. In the first case, the first pressure P1, the opening one of the passage valve 204, will be fixed at 0.9 bar (i.e. 0.3 bar lower than the design one), whereas the second pressure, the closing one of the passage valve 204, will be fixed at 1.1 bars (i.e. 0.1 bar lower than the design one and 0.2 bar higher than the first predetermined pressure). In the second case, the first pressure P1, the opening one, will be fixed at 1 bar (i.e. 0.8 bar lower than the design one), whereas the second pressure, the closing one, will be fixed at 1.4 bars (i.e. 0.4 bar lower than the design one and 0.4 bar higher than the first pressure). The greater the interval between the first pressure P1 and the second pressure P2, the greater the benefit of the refrigeration device 1 in terms of energy and efficiency since the compressor 1 will practically work at a practically null load in the interval between the opening and closing of the passage valve 204.

According to the invention, and according to the second embodiment of the invention shown in FIG. 3, wherein the secondary by-pass branch 200 comprises a heat exchanger 203, the method further comprises the step c) of cooling, by means of the heat exchanger 203, the refrigerant fluid circulating within the secondary by-pass branch 204 during at least the step b) of the method.

The invention claimed is:

1. A refrigeration device (100) having a closed circuit (C) within which a refrigerant fluid circulates, said closed circuit comprising at least one compressor (101), at least one condenser (102), expansion means (103) of said refrigerant fluid, at least one evaporator (104) to thermally condition, directly or indirectly, at least one user (UT), and at least one shut-off valve (105) operable between an open position and a closed position to regulate the flow of refrigerant fluid through said at least one evaporator depending on the temperature required by said at least one user, said closed circuit further comprising at least one secondary by-pass branch (200) having an inlet section (201) and an outlet section (202) respectively arranged downstream (D) and upstream (U) of said at least one compressor (101) for the passage of said refrigerant fluid, said secondary by-pass branch (200) comprising at least one passage valve (204) operable between an open position, to allow the fluid to recirculate between said secondary by-pass branch (200) and said at least one compressor (101), and a closed position, to prevent the passage of fluid through said secondary by-pass branch, wherein said closed circuit (C) comprises means (106) to prevent the backflow of said refrigerant fluid from said condenser to said compressor, at least when said passage valve (204) is open, said means to prevent the backflow of said refrigerant fluid being arranged between said condenser and said inlet section (201) of said secondary by-pass branch (200), wherein said at least one secondary by-pass branch (200) is sized and shaped so that the regime pressure difference (ΔPbypass) between upstream (U) and downstream (D) of said at least one compressor (101), when said at least one passage valve (204) is in its open position and said at least one shut-off valve (105) is in its closed position, is lower than the regime pressure difference (ΔP) between upstream and downstream of said at least one compressor (101), when said at least one shut-off valve (105) allows the passage through said at least one evaporator and said passage valve (204) is in its closed position.

2. The refrigeration device according to claim 1, wherein said means to prevent the backflow of said refrigerant fluid are arranged at said inlet section (201) of said secondary by-pass branch (200).

3. The refrigeration device according to claim 1, wherein said at least one secondary by-pass branch (200) is sized and shaped so that the regime pressure difference (ΔPbypass) between upstream and downstream of said compressor (101), at least when said at least one passage valve (204) is in its open position and said at least one shut-off valve (105) is in its closed position, is lower than 4 bars.

4. The refrigeration device according to claim 1, wherein said at least one passage valve (204) is sized so that the passage section, when said valve is open, is substantially equal to the section of said secondary by-pass branch to practically reduce pressure losses to zero.

5. The refrigeration device according to claim 1, wherein said means (106) to prevent the backflow of said refrigerant fluid comprise at least one non-return valve (106).

6. The refrigeration device according to claim 1, wherein said means (106) to prevent the backflow of said refrigerant fluid comprise at least one second shut-off valve respectively operable between an open position and a closed position to allow or prevent the passage of said refrigerant fluid, said at least one second shut-off valve being in open position, at least when said passage valve is closed, and being in its closed position, at least when said passage valve is open.

7. The refrigeration device according to claim 1, wherein said passage valve (204) and said means (106) to prevent the backflow of said refrigerant fluid comprise a three-way valve provided with at least one inlet section, at least one first outlet section and at least one second outlet section, which are closable/openable on command, said three-way valve being arranged so that said inlet section is fluidically connected to the outlet of said compressor, said first outlet section is fluidically connected to said secondary by-pass branch and said second outlet section is fluidically connected to said condenser, and functionally operating so that when said first outlet section is open, said at least one second outlet section is closed, and vice-versa.

8. The refrigeration device according to claim 1, further comprising at least one pressure sensor (107) to take the pressure (P) of the fluid entering said at least one compressor (101) and at least one control unit (UC) adapted to control the opening of said at least one passage valve (204), at least when said pressure sensor (107) detects that the pressure of the fluid entering the compressor (101) is identical to a first predetermined pressure, and controls the closing of said at least one passage valve when a second predetermined pressure is achieved, higher than said first predetermined pressure.

9. The refrigeration device according to claim 8, wherein said first predetermined pressure is lower of a value between 0.1 and 2 bars than the absolute pressure, calculated during the design phase, of the refrigerant fluid inside said evaporator, capable of maintaining said user at the desired temperature according to the refrigerant fluid used and to the size of said user, and said second predetermined pressure is higher of a value between 0.1 and 1.9 bars than said first predetermined pressure and is not higher than said absolute pressure, calculated during the design phase, of the refrigerant gas inside said evaporator, capable of maintaining said user at the desired temperature according to the refrigerant gas used and to the size of said user.

10. The refrigeration device according to claim 1, wherein said secondary by-pass branch (200) comprises at least one heat exchanger (203) to cool the fluid flowing through said secondary by-pass branch, wherein said at least one heat exchanger (203) is outside of said at least one secondary by-pass branch (200).

11. The refrigeration device according to claim 10, wherein said at least one heat exchanger (203) is of the plate, air or pipe type.

12. A method for operating at least one refrigeration device (1) according to claim 1, at least when said at least one compressor is operative and in full operation, comprising the steps of:

a) regulating the flow of said refrigerant fluid through said at least one evaporator depending on the temperature required by said user by means of said at least one shut-off valve (105);

b) recirculating said refrigerant fluid between said secondary by-pass branch (200) and said at least one compressor (101);

characterized in that said step b) comprises the step b1) of opening said at least one passage valve (204), and the step b2) of preventing the backflow of the refrigerant fluid from said condenser to said compressor.

13. The method according to claim 12, wherein, before said step b1), the step b0) is comprised of detecting the pressure (P) of the fluid entering said compressor (101) by means of a pressure sensor (107), and in that said step b) comprises the further step b3) of opening said at least one passage valve (204) at least when the pressure detected by said pressure sensor (107) at the inlet of said compressor (101) during said step b0) reaches a first predetermined pressure, wherein said first predetermined pressure is lower of a value between 0.1 and 2 bars than the absolute pressure (Pprog), calculated during the design phase, or named design pressure, of the refrigerant gas inside said evaporator, capable of maintaining said user at the desired temperature according to the refrigerant gas used and to the size of said user.

14. The method according to claim 13, wherein, after said step b3), the step b) comprises the step b4) of closing said at least one passage valve (204) at least when the pressure detected by said pressure sensor (107) at the inlet of said compressor (101) during said step b0) reaches a second predetermined pressure higher than said first predetermined pressure, wherein said second predetermined pressure is higher of a value between 0.1 and 1.9 bars than said first predetermined pressure and not higher than said absolute pressure (Pprog), calculated during the design phase, of the refrigerant gas inside said evaporator, capable of maintaining said user at the desired temperature according to the refrigerant gas used and to the size of the user.

15. The method according to claim 12, wherein said by-pass line (200) comprises at least one heat exchanger (203), characterized in that said method further comprises the step c) of cooling, by means of said at least one heat exchanger (203), the refrigerant fluid circulating inside said secondary by-pass branch during said step b) of the method.

* * * * *